US008015633B2

(12) United States Patent
Ho

(10) Patent No.: US 8,015,633 B2
(45) Date of Patent: Sep. 13, 2011

(54) RETRACTABLE SHOWER CURTAIN ROD

(76) Inventor: Edward Ho, Warren, NJ (US)

( * ) Notice: Subject to any disclaimer, the term of this patent is extended or adjusted under 35 U.S.C. 154(b) by 1360 days.

(21) Appl. No.: 11/510,100

(22) Filed: Aug. 25, 2006

(65) Prior Publication Data

US 2008/0047057 A1 Feb. 28, 2008

(51) Int. Cl.
*A47K 3/00* (2006.01)

(52) U.S. Cl. ..... 4/610

(58) Field of Classification Search ..... 4/557, 558, 4/607–610

See application file for complete search history.

(56) References Cited

U.S. PATENT DOCUMENTS 4,117,557 A * 10/1978 McPeak et al. ..... 4/610
4,754,504 A 7/1988 Cellini
5,216,766 A 6/1993 Lang
5,561,870 A 10/1996 Hertel
5,662,297 A * 9/1997 Christensen et al. ..... 211/105.1
D397,928 S 9/1998 Wise
D426,142 S 6/2000 Moore
6,263,523 B1 7/2001 Moore
6,694,543 B2 2/2004 Moore
D498,663 S 11/2004 Moore

* cited by examiner

*Primary Examiner* — Huyen Le

(74) *Attorney, Agent, or Firm* — Frommer Lawrence & Haug LLP

(57) ABSTRACT

A shower curtain rod assembly including a shower curtain rod, a mount for mounting the shower curtain road on a first end thereof, and a moveable mount for mounting the shower curtain rod on a second end thereof. The shower curtain is moveable from a first position to a second position to increase the volume of space enclosed by the shower curtain.

20 Claims, 12 Drawing Sheets

RETRACTABLE SHOWER CURTAIN ROD

FIELD OF THE INVENTION

The present disclosure is directed to a shower curtain rod and more particularly to a shower curtain rod which is extendable and retractable to fit above and in cooperation with a shower or bathtub. The show curtain rod is intended to be used to support a shower curtain to prevent water from splashing out of the enclosure bordered by the shower curtain as the curtain is draped into a bath tub below the curtain rod.

BACKGROUND

In the construction of most bathrooms, it is common to position a shower nozzle mounted on the wall in an enclosure above a bath tub to thereby provide the option of a shower for the resident using the bathroom facility. In defining such enclosures, splashing water out of the enclosure is limited by the use of a sliding door, typically a translucent plastic or shatter proof glass, or more conveniently, a shower curtain. The shower curtain is ordinarily constructed and arranged to drape loosely from a set of eyelets or curtain rings which slide along the curtain rod. A set of such rings is normally mounted slidably on the shower curtain rod which is positioned normally at the height of the sprinkler head or other nozzle. The shower curtain is draped in the bath tub below so that water is not splashed out of the bath tub. Because the bath tub is below the shower nozzle, the bath tub functions to collect water which drains from the bath tub during the shower.

Many bath tubs, indeed most bath tubs, are constructed with a straight exposed side. Straight side bath tubs are constructed so that they can be positioned immediately below a straight shower rod. In the use of a straight shower rod, the drape of the shower curtain is fairly well defined by the support provided overhead by the shower rod. Since the shower rod is straight, the bath tub itself defines a companion or parallel, perhaps slightly inset, opening where the loosely hanging shower curtain can be directed. In that event, the shower curtain is positioned so that all of the splashed water is maintained in the bath tub. In a rectangular bath tub, this is accomplished through the use of a straight shower curtain rod. A straight shower curtain rod is typically provided with a central straight portion having a length approximately equal to that of the bath tub and which also includes offset end rod portions which enable connection with the tile wall which surrounds the bath tub. In that construction, the bath tub is positioned below the rod so that the shower curtain can drape in the tub. Straight shower curtain rods typically have a straight length portion with end portions which approximately conforms to the length or profile of the bath tub when viewed from above.

While functional, and even generally effective, straight shower curtain rods have the significant drawback of limiting the space available inside the shower. Particularly for larger persons or for those who prefer to have more space available to them in the shower, the relatively narrow width of the bathtub does not provide enough room for them to shower comfortably. To address this point one approach has been to form curved shower curtain rods. The curvature of the shower curtain rod increases the volume of space available to a user behind the shower curtain. But these too have the drawback of significantly reducing the amount of space in the bathroom outside of the shower. Further, for many applications, particularly with essentially square bathtubs, the curved shower rods are unsightly and the shower curtains do not hang from them in an aesthetically pleasing manner.

The present invention endeavors to overcome the problems of the prior art and provide shower curtain rod which is extendable in an outward direction from the bathtub to create more space when in use, but which may be returned to the retracted position when not in use.

SUMMARY OF THE INVENTION

One aspect of the present invention is a shower curtain rod assembly including a shower curtain rod, a mount for mounting the shower curtain rod on a first end thereof, and a moveable mount for mounting the shower curtain rod on a second end thereof. Another aspect of the present invention is directed to a shower curtain rod assembly including a shower curtain rod, a moveable first mount for mounting the shower curtain rod on a first end thereof, and a moveable second mount for mounting the shower curtain rod on a second end thereof. In all aspects of the present invention, the shower curtain is moveable from a first position to a second position to increase the volume of space enclosed by the shower curtain.

Additional aspects of the instant invention may include the moveable mount having a track and a sliding mount. The track may include a stop which runs in a track formed on a surface of the sliding mount to prevent the movement of the shower curtain rod beyond a predetermined position. Further, the sliding mount may run in slots formed in a rail portion of the track, the rail portion having an angle to a flat surface of the track where the track is mounted to a side wall of a shower. In addition, the rail portion may be substantially parallel to a flat surface of the track where the track is mounted to a side wall of a shower. In one aspect of the present invention the shower curtain rod assembly may include an end cap connected to an end of the sliding mount for preventing the sliding mount from moving beyond a predetermined point. Further, the shower curtain rod may be rotatably mounted to a hinged mount and to the sliding mount. Lastly, in all configurations, the shower curtain rod assembly may include an electric motor system so that the shower curtain may be automatically moved away from a shower, once a user begins to shower.

Another aspect of the present invention is a method of increasing a volume of space defined by a shower curtain and a bathtub, the method includes a step of providing a shower curtain rod assembly having a shower curtain rod, a first mount connecting a first end of a shower curtain rod to a first wall surface, and a second mount connecting a second end of the shower curtain rod to a second wall surface. One or both of the first and second mounts may be used to slidably connect the shower curtain rod to the wall surfaces. The method also includes a step of applying pressure to one or both ends of the shower curtain rod, wherein the application of pressure moves a slidable portion of one or both of the first and second mounts in relation to a track portion of the slidable mount(s) such that the shower curtain rod moves away from the bathtub and the shower curtains original position.

The method may also include a step of applying pressure on the shower curtain rod to return the shower curtain rod to its original position. Further, upon application of pressure to the second end of the shower curtain rod, a sliding mount portion of the second mount may slide along a track portion of the second mount. The track portion may include a stop preventing movement of the sliding mount portion beyond a predetermined point.

A further aspect of the present invention is a method of preventing water from splashing out of a bathtub. The method includes a step of providing a shower curtain rod assembly including a shower curtain rod, a first mount connecting a first end of a shower curtain rod to a first wall surface, and a second mount connecting a second end of the shower curtain rod to a second wall surface. A further step of the method includes attaching a shower curtain to the shower curtain rod so that the shower curtain remains inside the bathtub when applying pressure to one or both of the first and second ends of the shower curtain rod, wherein the application of pressure moves a slidable portion of one or both of the first and second mounts in relation to a track portion of the slidable mount such that the shower curtain rod moves away from the bathtub and the shower curtain's original position.

Further aspects of this method may include application of pressure to one or both of the first and second ends of the shower curtain rod which may cause a sliding mount portion of one or both of the first and second mounts to slide along a track portion of the mount(s). The sliding mount portion includes may include at least one hook for attaching an end of the shower curtain. The portion of the shower curtain attached to the sliding mount prevents water from splashing out of the bathtub following movement of the shower curtain rod away from the bathtub and the shower curtain's original position. The track portion may include a stop preventing movement of the sliding mount portion beyond a predetermined point. And the method may include a step of applying pressure on the shower curtain rod to return the shower curtain rod to its original position.

In this text, the terms "comprising," "comprise," "comprises" and other forms of "comprise" can have the meaning ascribed to these terms in U.S. Patent Law and can mean "including," "include," "includes" and other forms of "include."

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE FIGURES

In the following detailed description of the invention, reference will be made to the accompanying drawings, incorporated herein by reference, wherein.

DETAILED DESCRIPTION

Figure 1:
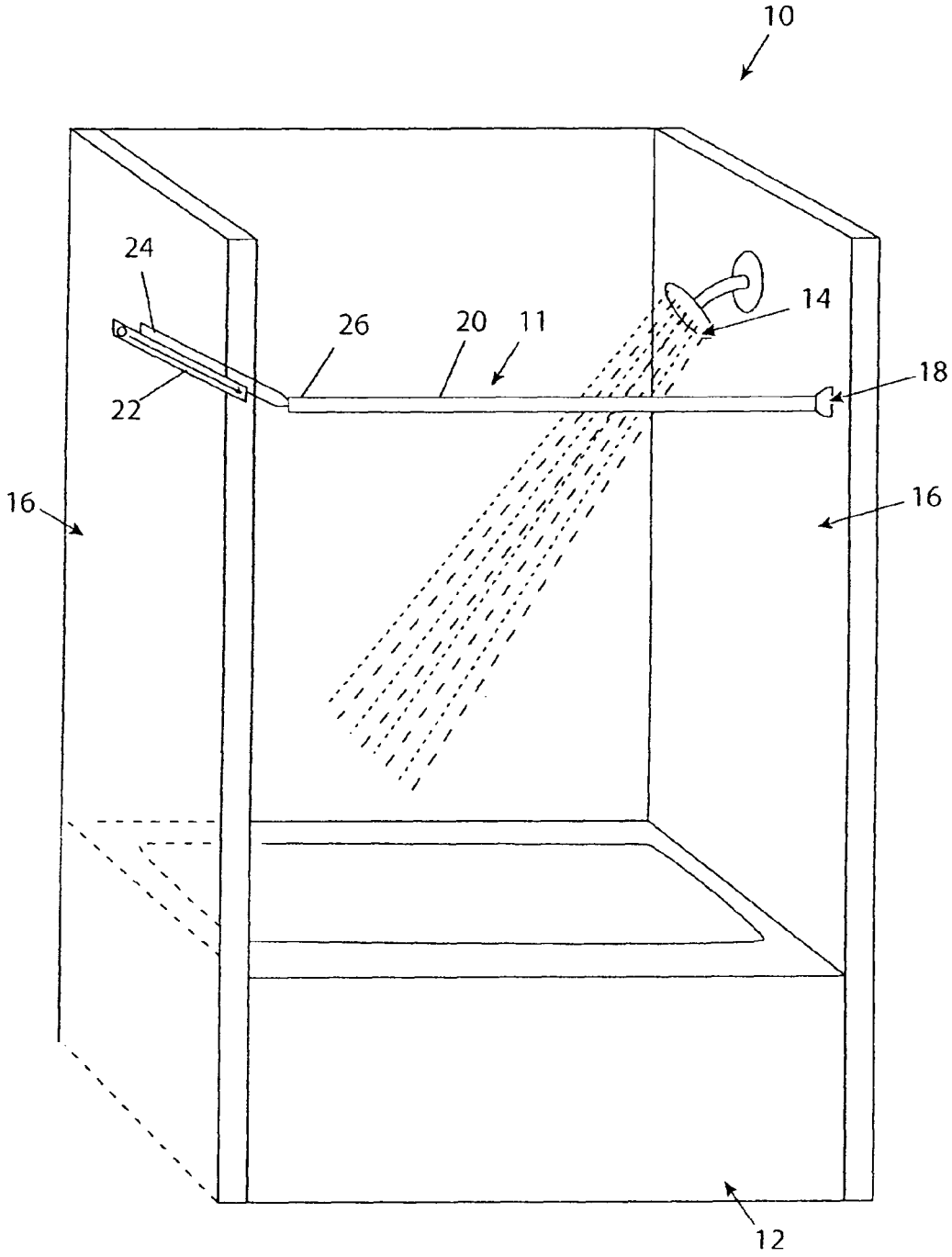
FIG. 1 is a perspective view of a shower and shower curtain rod according to one aspect of the present invention.
Figure 2:
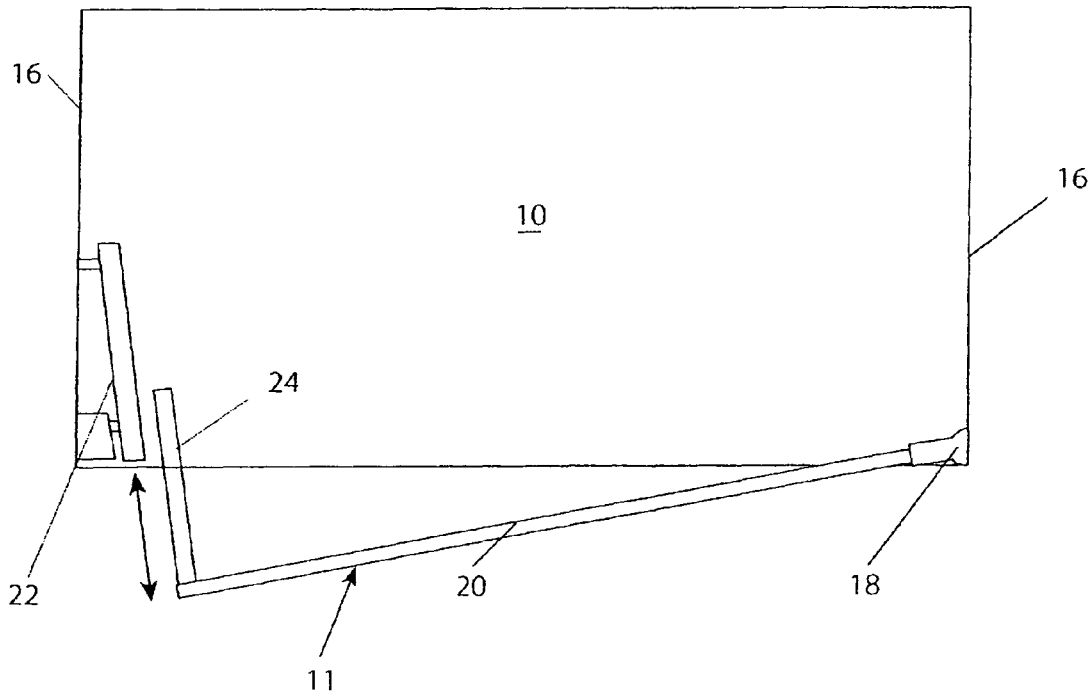
FIG. 2 is a top view of a shower and shower curtain rod according to one aspect of the present invention.

FIG. 1 provides a perspective view of a first embodiment of the present invention. In FIG. 1, the shower 10 is comprised of a tub 12, a shower head 14 and two side walls 16. The shower head 14 is mounted to one of the side walls 16. Also mounted in the shower 10 is a retractable shower curtain rod 11. The retractable shower curtain rod 11 is comprised of a curtain rod 20 having a fixed length that is connected to a hinged mount 18 at a first end of the curtain rod 11 and a sliding mount 24 attached at a second end of the curtain rod 11. As used herein, a fixed-length curtain rod is either a single piece curtain rod that is the desired length or at least a two-piece curtain rod whose length is capable of being adjusted by a user to obtain a desired length and then locked in place to maintain the desired curtain rod length. The sliding mount 24 is disposed or rests on a track 22 that is attached to the side wall 16 of the shower 10. FIG. 2 provides a top view of the retractable shower curtain rod 11 of the first embodiment installed in a shower 10.

By application of force to the curtain rod 20 in a direction away from the shower 10, the volume of space behind the shower curtain can be increased. The curtain rod 20 rotates on the hinge mount 18. The rotation of the curtain rod 20 moves the sliding mount 24 along the track 22 in the direction of the curtain rod 20. Movement of the curtain rod 20 is indicated throughout the figures with double-headed arrows.

This combination provides a retractable shower curtain rod 11 that results in the volume of a shower being increased when the retractable shower curtain rod 11 is extended and, at the same time, allows the shower curtain rod 20 to appear in its traditional location with a vertically oriented shower curtain when in the retracted position.

FIGS. 3*a*-6 provide further details of one advantageous combination of elements operable in the manner of the retractable shower curtain rod 11 disclosed above.

Figures 3A, 3B, 3C, 3D:
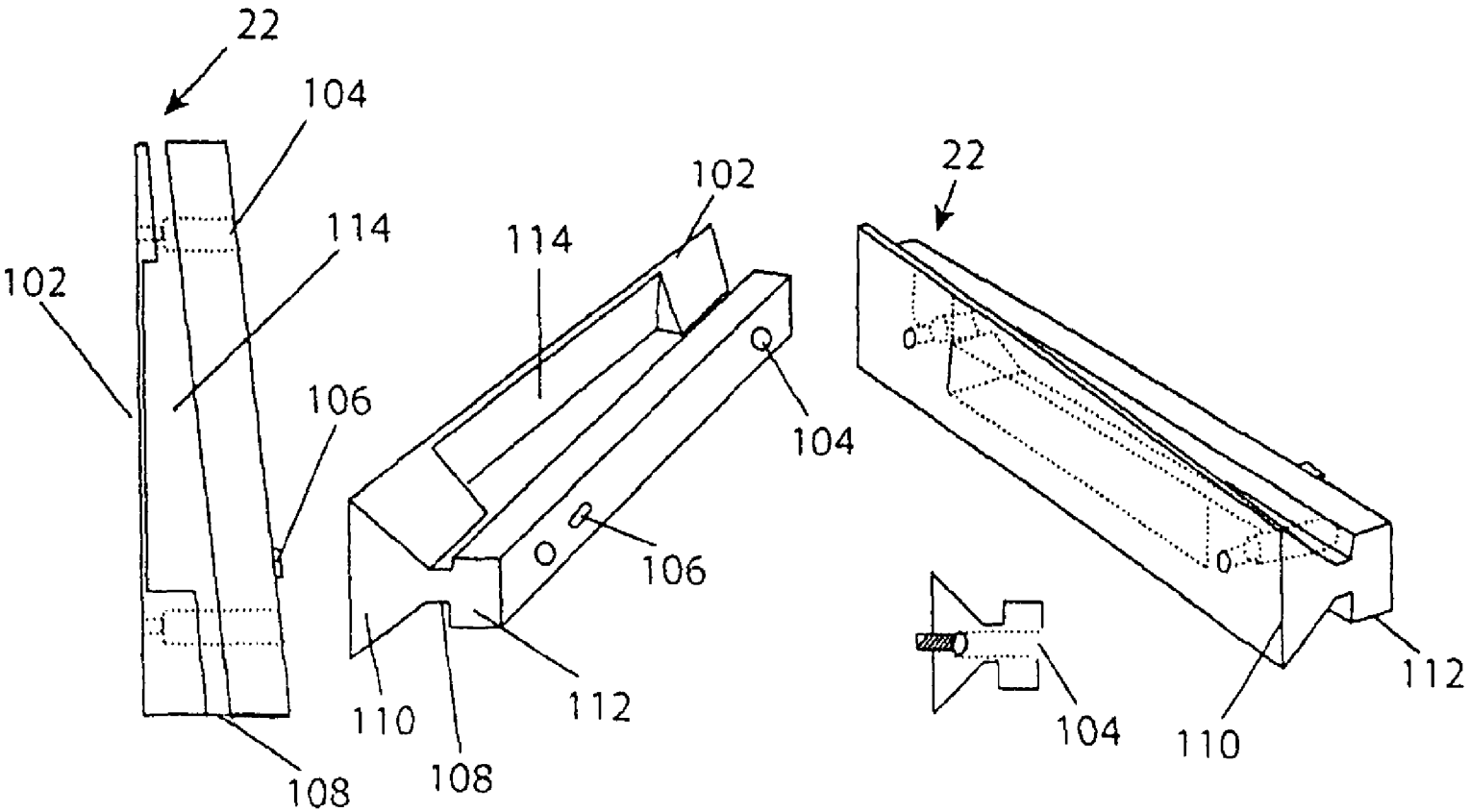
FIG. 3*a* is a top view of a track according to one aspect of the present invention.
FIG. 3*b* is a perspective view of a track according to one aspect of the present invention.
FIG. 3*c* is a rear perspective view of a track according to one aspect of the present invention.
FIG. 3*d* is a cross-section view of a track according to one aspect of the present invention.

FIGS. 3*a*-3*d* provide alternate views of the track 22. The track includes a base 102 which mounts flush to the side walls 16 of a shower. Traversing the track 22 are two bolt holes 104, which as shown in FIG. 3*a*, are countersunk to allow the head of a bolt inserted therein to be recessed away from an exterior surface of the track 22. A close-up view of this feature is shown in FIG. 3*d*. The track 22 also includes a stop 106, which prevents the sliding mount 24 from extending beyond a predetermined point or from being pulled off of the track 22. The track 22 also includes a "T-shaped" rail portion 112 where slots 108 in the top and bottom of the rail portion 112 receive portions of the sliding mount 24, allowing the sliding mount 24 to move back and forth between the retracted and extended positions. The "T-shaped" rail portion 112 is formed in the track 22 at an angle to the flat base 102. This angle eases movement of the sliding mount 24 along the track 22. Because the curtain rod 20 is a fixed-length, the angled rail 112 allows the sliding mount 24 to move away from the shower side wall 16 as the retractable shower curtain rod moves away from the shower. That is, the angled rail portion 112 compensates for the additional length of the curtain rod 20 that is needed when moving the retractable shower curtain rod 11 away from the shower 10.

FIG. 3*b* shows a perspective view of the track 22 having a pyramid-shaped portion 110 in cross-section. The pyramid cross-section provides a larger contact surface that promotes surface stability when mounted. At the end of the pyramid section is the "T-shaped" rail portion 112 in which the sliding mount 24 rests. The "T-shape" of the rail portion 112 prevents the sliding mount 24 from being pulled out of the slots 108 or off of the track 22. Another feature of the track 22 is the cut-out 114 which limits the amount of sliding friction acting on the sliding mount 24 when moved.

Figure 4A:
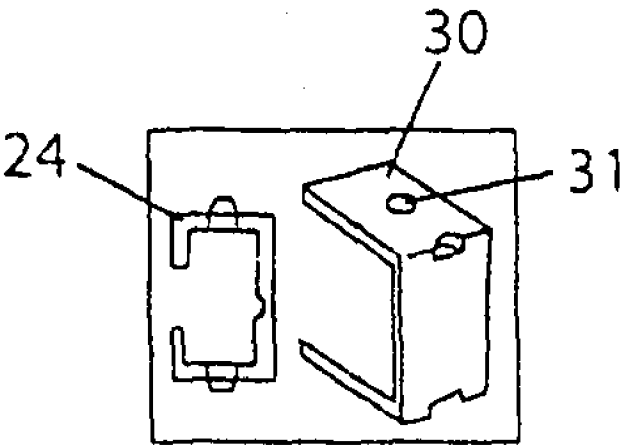
FIG. 4*a* is an end view of the sliding mount of FIG. 4 and a perspective view of an end cap according to one aspect of the present invention.
Figure 4:
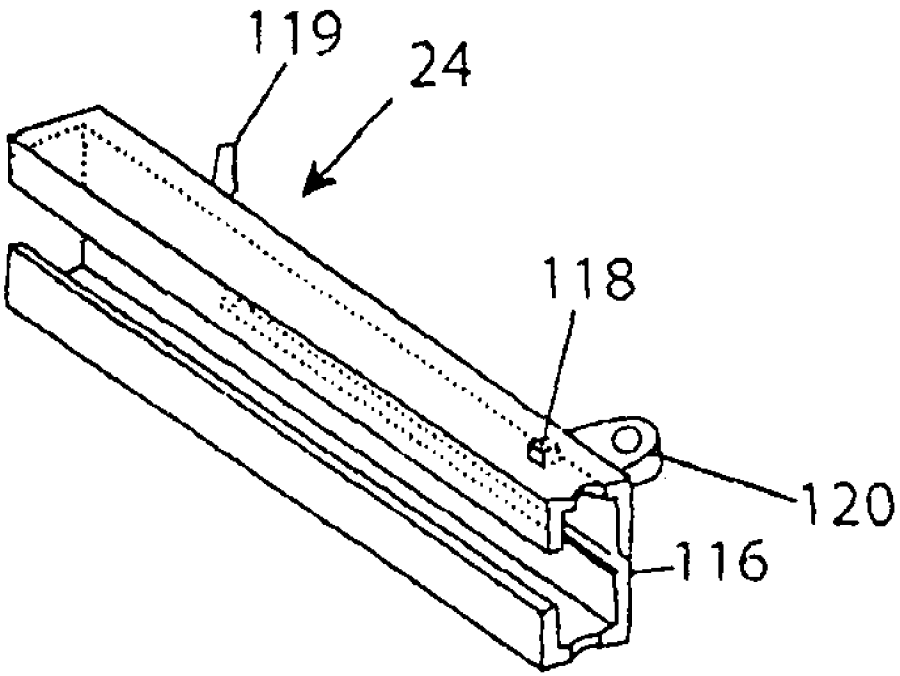
FIG. 4 is a perspective view of a sliding mount according to one aspect of the present invention.

FIG. 4 is a profile view of the sliding mount 24. As can be seen, the sliding mount 24 has a cross-sectional profile which essentially conforms to the "T-shaped" rail portion 112 of the track 22. As will be readily apparent to those skilled in the art, the cross-sectional shape of the rail portion 112 can be any shape that allows a complimentary-shaped sliding mount 24 to slide back and forth on and which also prevents the sliding mount 24 from being pulled off of or away from the track 22. Furthermore, as can be seen in FIG. 4, formed in an interior portion of the sliding mount 24 is a track 116. This track 116 mates with the stop 106 allowing the sliding mount 24 to move along the track 22 until the stop on the track 22 impacts a distal end of the track 116. On a distal end of the sliding mount 24 is a hook 119 for hanging a towel or the like. As will be readily apparent to those skilled in the art, additional hooks may be included on any element or component of the retractable shower curtain rod assembly.

FIG. 4*a* shows a side view of the sliding mount 24 and a perspective view of an end cap 30 which is placed on the end of the sliding mount 24. The end cap 30 prevents the sliding mount 24 from being pushed onto the track 22 beyond the end of the sliding mount 24. In the top and bottom of the end cap 30 are holes 31 which conform to and slide over projections 118 formed on the sliding mount 24 to secure the cap 30 to the sliding mount 24.

Figure 6:
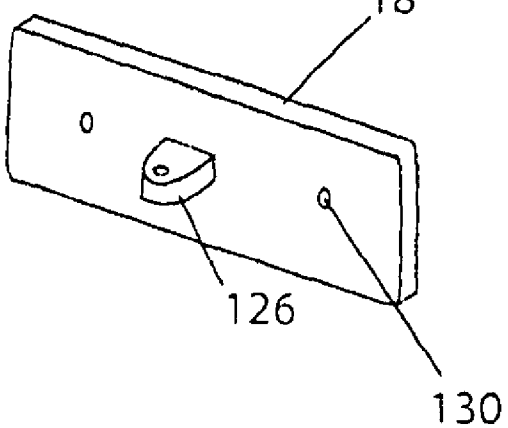
FIG. 6 is a perspective view of a hinged mount according to one aspect of the present invention.
Figure 5A:
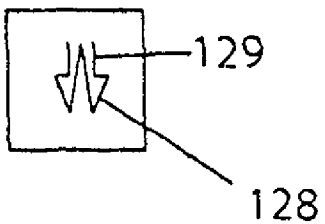
FIG. 5*a* is a profile view of a connector for the shower curtain rod of FIG. 5.
Figure 5:
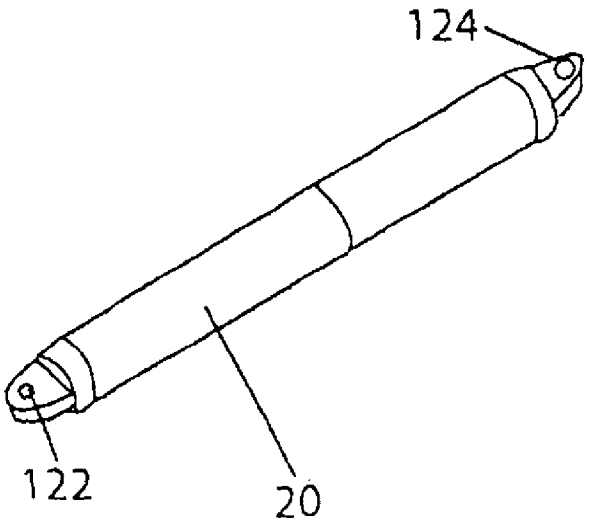
FIG. 5 is a perspective view of a shower curtain rod track according to one aspect of the present invention.

Formed on the sliding mount 24 is an eye 120. The eye 120 mates with a second eye 122 formed on the curtain rod 20 shown in FIG. 5. This is preferably a pinned connection which allows movement of the curtain rod 20 with respect to the sliding mount 24 when moved to the retracted or extended position. On the opposite end of the curtain rod 20 is another eye 124 which mates up with an eye 126 formed on the hinged mount 18. As shown in FIG. 5*a*, the underside of the eye 124 may have a clip-fitting 128 for insertion into the eye 126. The pin portion 129 of the clip fitting 128 allows the curtain rod 20 to rotate about the eye 126. As shown in FIG. 6, the hinged mount 18 includes two holes 130 for securing the hinged mount 18 to the sidewalls 16.

Figure 7A:
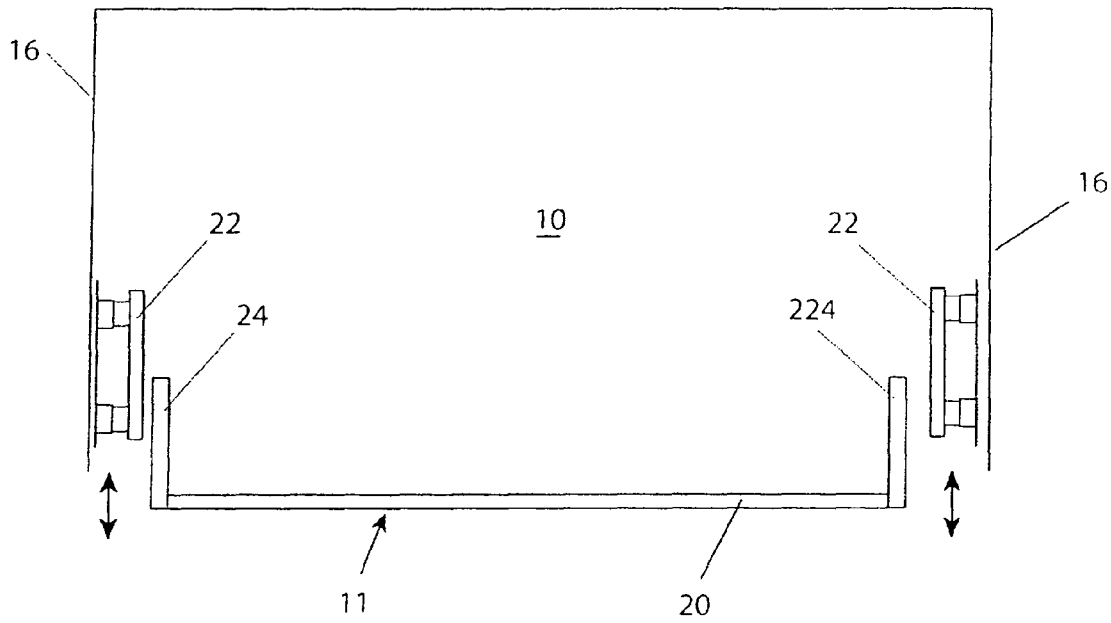
FIG. 7*a* is a top view of a shower and shower curtain rod according to one aspect of the present invention.
Figure 7B:
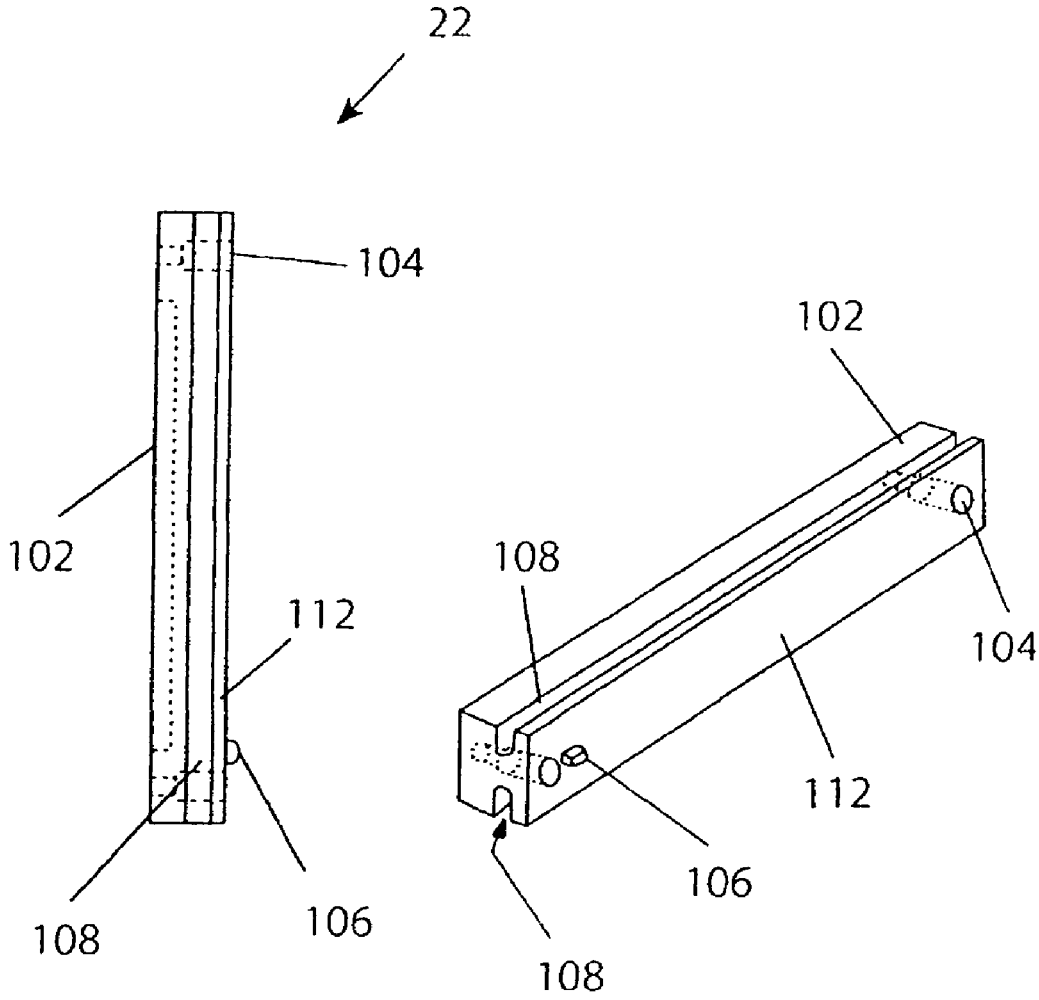
FIG. 7*b* is a top and a perspective view of a track according to one aspect of the present invention.

Depicted in FIG. 7*a* is a second embodiment of the present invention that is similar to the first embodiment disclosed above, however, instead of using a track 22 with an angled rail portion 112 and a hinged mount 18 to mount the retractable shower curtain rod 11 to a shower, two tracks 22, as depicted in FIG. 7*b*, having rail portions 112 that are not angled and are instead substantially parallel to the shower side walls 16 and the flat base 102, are used to mount the retractable shower curtain rod 11. In this embodiment the tracks 22 and sliding mounts 24 allow both sides of the curtain rod 20 to slide away from the shower in a manner similar to the operation of a drawer. Therefore, a retractable shower curtain rod 11 according to this embodiment permits a user to increase the volume of the shower more than that increased by the first embodiment.

Figure 8:
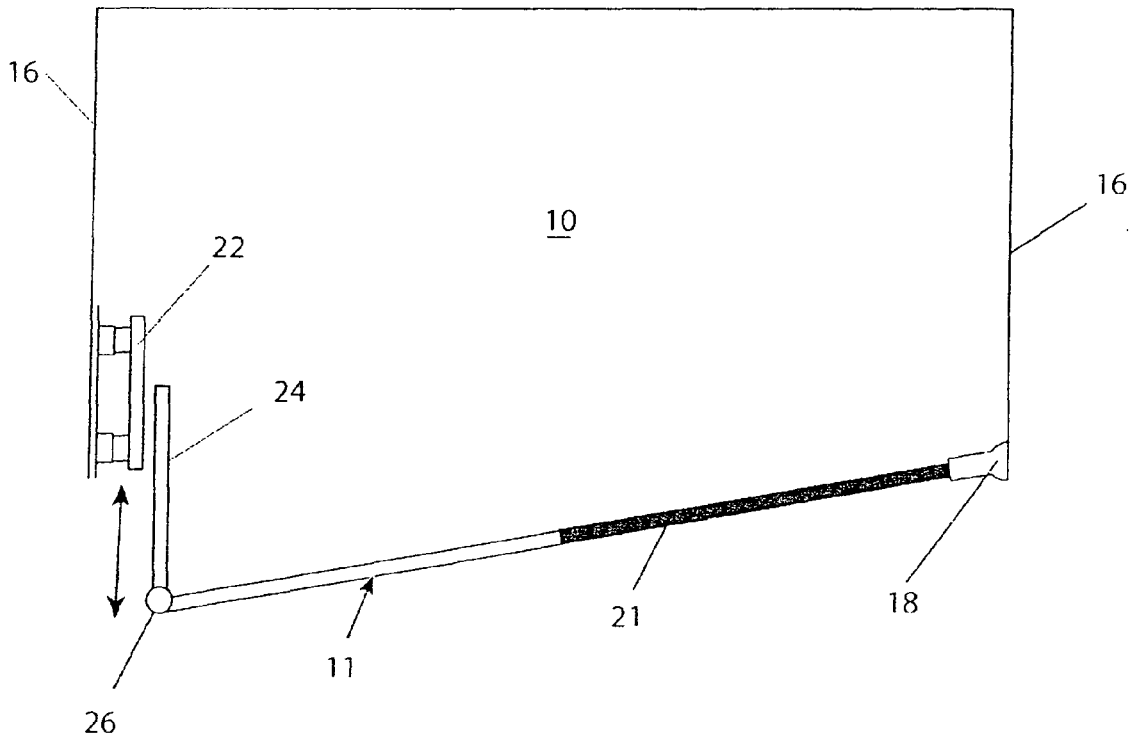
FIG. 8 is a top view of a shower and shower curtain rod according to one aspect of the present invention.

In a third embodiment of the present invention that is similar to the first embodiment, as depicted in FIG. 8, instead of using a track 22 with an angled rail portion 112 and a hinged mount 18 to mount the retractable shower curtain rod 11 to a shower, a hinged mount 18 and a track 22 with a rail portion that is not angled and is instead substantially parallel to the shower side walls 16 and the flat base 102, as depicted in FIG. 7*b*, are used. With this embodiment, however, an extendable/collapsible curtain rod 21, which uses a hinge 26 at the point of connection between the curtain rod 21 and the sliding mount 24 is used. The combination of the extendable/collapsible curtain rod 21 and hinge 26 permits the curtain rod 21 to extend or elongate when the shower curtain is moved away from the shower and to collapse or retract when the shower curtain is moved back toward the shower. In this embodiment, application of a force to the curtain rod 21 in a direction away from the shower causes the curtain rod to rotate on the hinge mount 18. The rotation of the curtain rod 21 moves the sliding mount 24 along the track 22 in the direction of the curtain rod 21. At the same time, the hinge 26 allows for rotation of the sliding mount 24 in relation to the curtain rod 21. Because the sliding mount 24 is moving in a direction parallel to the side walls 19 of the shower, the length of the curtain rod 21 must be increased to compensate for the shortening horizontal distance 29 between the hinged mount 18 and the hinge 26 as the curtain rod 20 moves away from the shower. Consequently, a curtain rod 21 that is capable of extending or elongating and retracting or collapsing is used.

Figure 9:
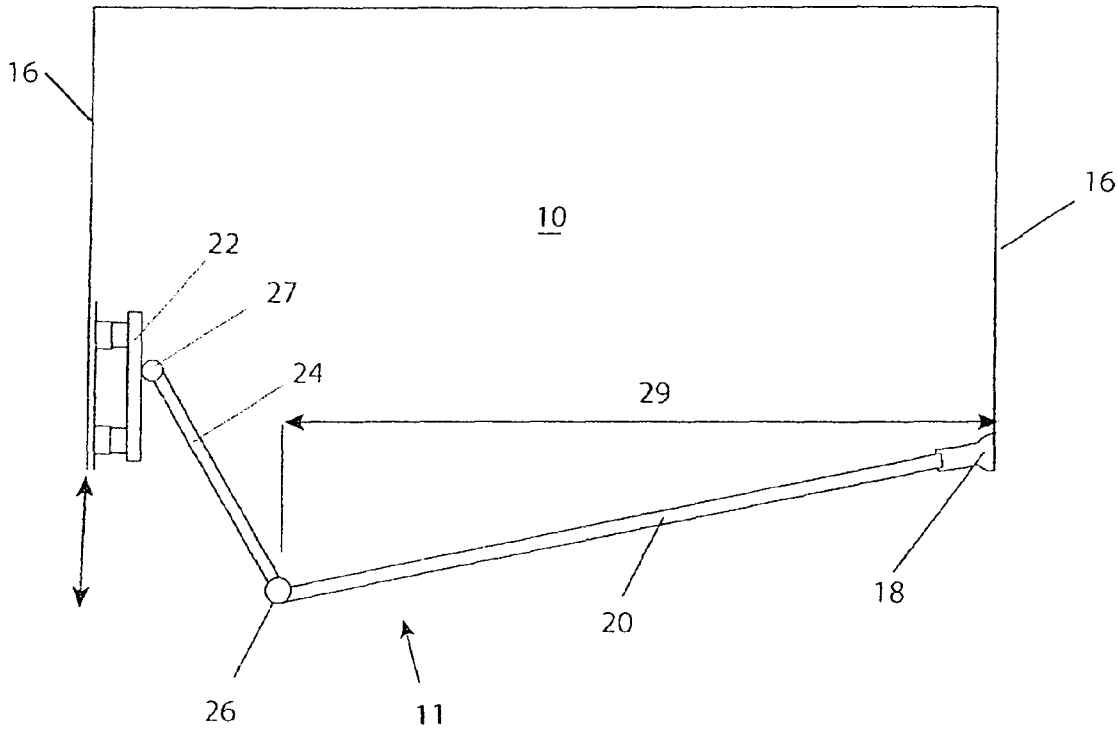
FIG. 9 is a top view of a shower and shower curtain rod according to one aspect of the present invention.

In a fourth embodiment of the present invention that is similar to the third embodiment, as depicted in FIG. 9, instead of using an extendible/collapsible or retractable curtain rod, a fixed-length curtain rod 20 may be used in combination with a track 22, as depicted in FIG. 7*b*, having a rail portion 112 that is substantially parallel to the shower sidewalls 16 and the flat base 102 and a hinged mount 18. In this embodiment, however, in addition to the curtain rod 20 connecting to the sliding mount 24 with a hinge 26, the sliding mount 24 itself connects to the track 22 with a hinged connection 27. Therefore, in this embodiment, the combination of the three hinged connections (hinged mount 18, hinge 26 and hinged connection 27) allows the fixed-length curtain rod 20 to be moved in a direction away from the shower upon application of a forced to the curtain rod 20 in a direction away from the shower. This is possible because the hinged connection 27 between the sliding mount 24 and the track 22 allows the sliding mount 24 to pull or move away from the shower side wall 16 to compensate for the shortening horizontal distance 29 between the hinged mount 18 and the hinge 26 as the curtain rod 20 moves away from the shower.

Figure 10:
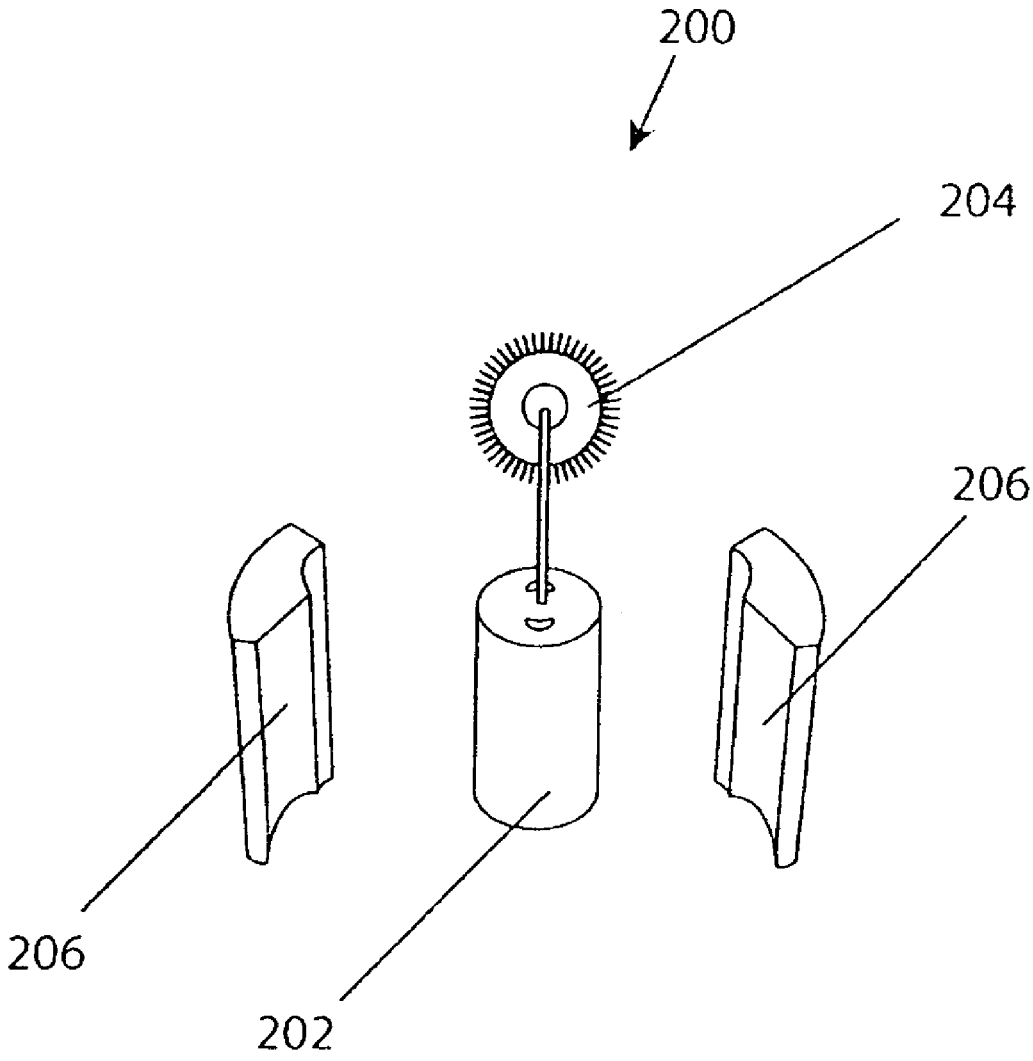
FIG. 10 is a perspective view of a motor for use with the present invention.
Figure 11:
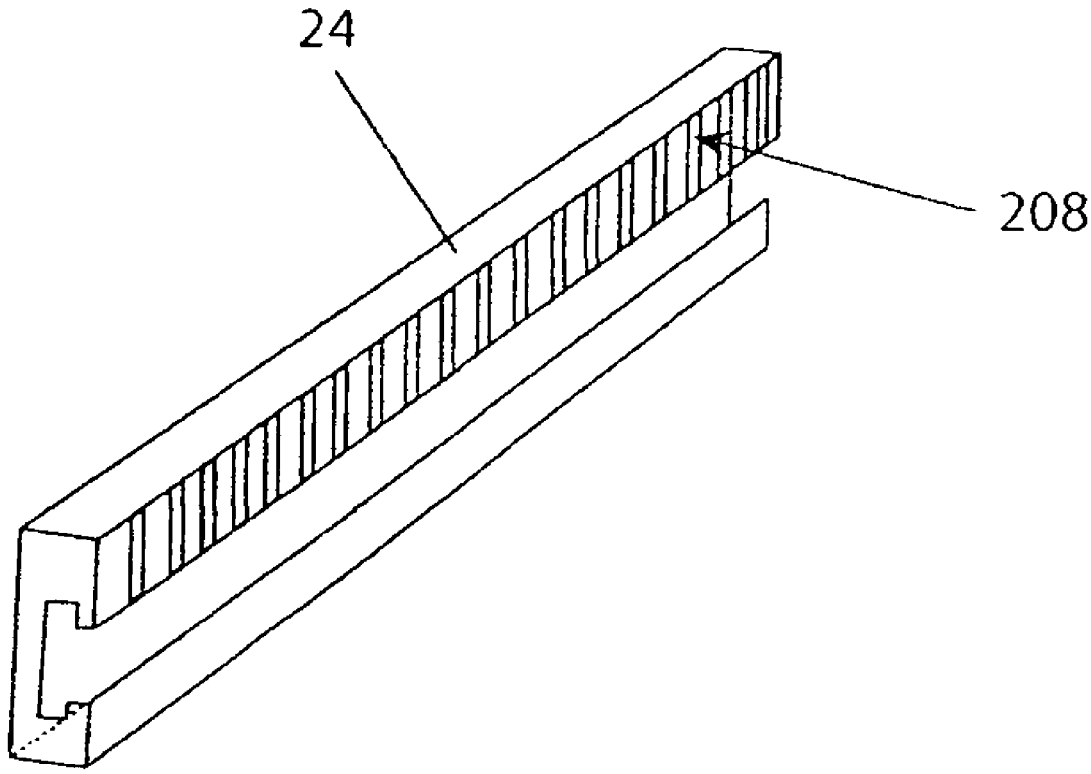
FIG. 11 is a perspective view of a sliding mount to be used with the motor depicted in FIG. 9.

In all of the disclosed embodiments, an electric motor system may be used to drive the retractable curtain rod 11. As depicted in FIG. 10, the motor 200 comprises a drive motor 202, a gear 204, which may be a helical gear or a spur gear, and a water or splash resistant shell 206. The motor 200 attaches to the track 22. To drive the motor, a battery pack, which is connected to the motor, is also attached to the track 22. When a motor is used, the typical sliding mount 24 is replaced with a sliding mount 24 that, as depicted in FIG. 11, has a rack or a track with teeth 208 that meshes with the teeth on the motor gear 204. Therefore, when the motor is activated and rotates, the gear 204 in combination with the rack 208 convert rotary motion into linear motion, moving the sliding mount 24 and hence the curtain rod away from and back toward the shower.

Figure 12:
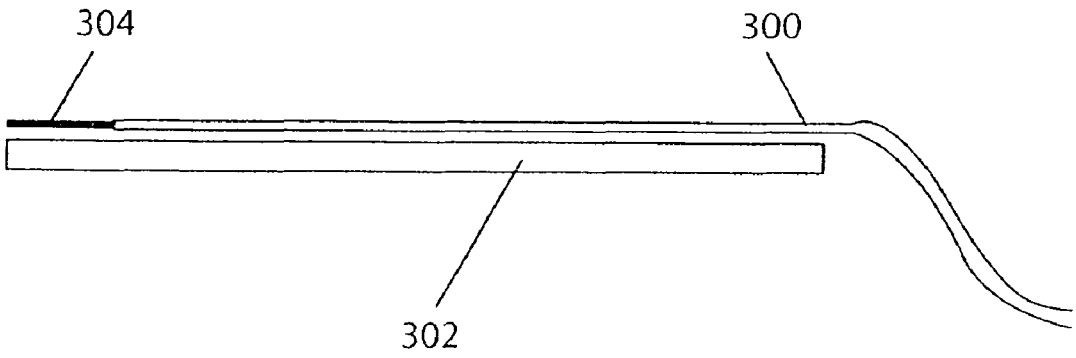
FIG. 12 is a side view of a shower curtain rod having a flat wire attached according to one aspect of the present invention.

The electric motor system operates as follows. A trigger cable that is connected to the battery pack connects to a microprocessor. Connected to the microprocessor is an adhesive flat wire. As depicted in FIG. 12, the adhesive flat wire 300 is attached to the curtain rod 302 along the length of the curtain rod 302. The last several inches of the flat wire is an integrated pressure switch 304. Pressure from a shower curtain ring that is placed in contact with the portion of the flat wire 300 that comprises the integrated pressure switch 304, triggers or activates the switch that operates the electric motor. Consequently, once a person is in the shower and the shower curtain is closed, the electric motor, now activated by pressure from the shower curtain ring, operates to move the retractable shower curtain rod away from the shower, thereby increasing the volume of the shower for the user. When an embodiment of the invention having only one sliding mount 24 is used, only one electric motor system is needed. When an embodiment of the instant invention having two sliding mounts 24 is used, two electric motor systems may be used.

Lastly, in order to increase the ease at which the sliding mount(s) 24 slide back and forth along the track 22, bearings, wheels, rollers or any other type of sliding mechanism, may be used in the sliding mounts 24 or on the track 22.

Having thus described in detail preferred embodiments of the present invention, it is to be understood that the invention defined by the above paragraphs is not to be limited to particular details set forth in the above description, as many apparent variations thereof are possible without departing from the spirit or scope of the present invention.

I claim:

1. A shower curtain rod assembly comprising:

a shower curtain rod;

a first mount for mounting the shower curtain rod on a first end thereof; and a moveable second mount for mounting the shower curtain rod on a second end thereof, the moveable second mount comprising a track and a sliding mount, wherein the track includes a stop which runs in a track formed on a surface of the sliding mount to prevent the movement of the shower curtain rod beyond a predetermined position;

wherein said shower curtain rod is moveable from a first position to a second position to increase the volume of space enclosed by the shower curtain.

2. The shower curtain rod assembly of claim 1, wherein said track has a rail portion.

3. The shower curtain rod assembly of claim 1, further comprising at least one hook.

4. A shower curtain rod assembly comprising:

a shower curtain rod;

a first mount for mounting the shower curtain rod on a first end thereof; and a moveable second mount for mounting the shower curtain rod on a second end thereof, the moveable second mount comprising a track and a sliding mount, wherein said track has a rail portion and the sliding mount runs in slots formed on the rail portion, said rail portion having an angle to a flat surface of said track where said track is mounted to a side wall of a shower;

wherein said shower curtain rod is moveable from a first position to a second position to increase the volume of space enclosed by the shower curtain.

5. A shower curtain rod assembly comprising:

a shower curtain rod;

a first mount for mounting the shower curtain rod on a first end thereof;

a moveable second mount for mounting the shower curtain rod on a second end thereof, the moveable second mount comprising a track and a sliding mount; and an end cap connected to an end of the sliding mount for preventing the sliding mount from moving beyond a predetermined point;

wherein said shower curtain rod is moveable from a first position to a second position to increase the volume of space enclosed by the shower curtain.

6. A shower curtain rod assembly comprising:

a shower curtain rod;

a first mount for mounting the shower curtain rod on a first end thereof; and a moveable second mount for mounting the shower curtain rod on a second end thereof, the moveable second mount comprising a track and a sliding mount;

wherein the shower curtain rod is rotatably mounted to a hinged mount and to the sliding mount, and said shower curtain rod is moveable from a first position to a second position to increase the volume of space enclosed by the shower curtain.

7. A shower curtain rod assembly comprising:

a shower curtain rod;

a first mount for mounting the shower curtain rod on a first end thereof; and a moveable second mount for mounting the shower curtain rod on a second end thereof, the moveable second mount comprising a track and a sliding mount;

wherein said shower curtain rod is attached to said sliding mount with a hinge, and said shower curtain rod is moveable from a first position to a second position to increase the volume of space enclosed by the shower curtain.

8. A shower curtain rod assembly comprising:

a shower curtain rod;

a first mount for mounting the shower curtain rod on a first end thereof;

a moveable second mount for mounting the shower curtain rod on a second end thereof; and at least one hinge;

wherein said shower curtain rod is moveable from a first position to a second position to increase the volume of space enclosed by the shower curtain.

9. The shower curtain rod assembly of claim 8, wherein each of the respective first and second ends of the shower curtain rod is coupled to at least one of said at least one hinge.

10. The shower curtain rod assembly of claim 9, wherein the shower curtain rod is extendable and retractable.

11. A method of increasing a volume of space defined by a shower curtain and a bathtub comprising:

providing a shower curtain rod assembly including a shower curtain rod, a first mount connecting a first end of a shower curtain rod to a first wall surface, and a second mount connecting a second end of the shower curtain rod to a second wall surface, wherein only one of the first and second mounts slidably connects the ends of the shower curtain rod to the corresponding one of the first and second wall surfaces;

applying pressure to the one of the first and second ends of the shower curtain rod that is slidably connected to one of the first and second wall surfaces, wherein the application of pressure moves a slidable portion of the corresponding one of the first and second mounts in relation to a track portion of the slidable mount such that the shower curtain rod moves away from the bathtub and the shower curtain's original position.

12. The method of claim 11, further comprising applying pressure on the shower curtain rod to return the shower curtain rod to its original position.

13. The method of claim 12, wherein the track portion includes a stop preventing movement of the sliding mount portion beyond a predetermined point.

14. The method of claim 11, wherein upon application of pressure to the corresponding one of the first and second ends of the shower curtain rod, a sliding mount portion of the corresponding one of the first and second mounts slides along a track portion of the corresponding one of the first and second mounts.

15. A method of preventing water from splashing out of a bathtub comprising:

providing a shower curtain rod assembly including a shower curtain rod, a first mount connecting a first end of a shower curtain rod to a first wall surface, and a second mount connecting a second end of the shower curtain rod to a second wall surface, wherein only one of the first and second mounts slidably connects the ends of the shower curtain rod to the corresponding one of the first and second wall surfaces;

attaching a shower curtain to the shower curtain rod so that the shower curtain remains inside the bathtub when applying pressure to the one of the first and second ends of the shower curtain rod that is slidably connected to one of the first and second wall surfaces, wherein the application of pressure moves a slidable portion of the corresponding one of the first and second mounts in relation to a track portion of the slidable mount such that the shower curtain rod moves away from the bathtub and the shower curtain's original position.

16. The method of claim 15, wherein upon application of pressure to the corresponding one of the first and second ends of the shower curtain rod, a sliding mount portion of the corresponding one of the first and second mounts slides along a track portion of the corresponding one of the first and second mounts.

17. The method of claim 16, wherein the sliding mount portion includes at least one hook for attaching an end of the shower curtain.

18. The method of claim 17, wherein the portion of the shower curtain attached to the sliding mount prevents water from splashing out of the bathtub following movement of the shower curtain rod away from the bathtub and the shower curtain's original position.

19. The method of claim 16, wherein the track portion includes a stop preventing movement of the sliding mount portion beyond a predetermined point.

20. The method of claim 15, further comprising of applying pressure on the shower curtain rod to return the shower curtain rod to its original position.

* * * * *